United States Patent [19]

Kememy

[11] Patent Number: 4,858,513

[45] Date of Patent: Aug. 22, 1989

[54] ELECTROMAGNETIC LAUNCHER WITH IMPROVED RAIL ENERGY RECOVERY OR DISSIPATION

[75] Inventor: George A. Kememy, Wilkins Township, Allegheny County, Pa.

[73] Assignee: Westinghouse Electric Corp., Pittsburgh, Pa.

[21] Appl. No.: 564,050

[22] Filed: Dec. 21, 1983

[51] Int. Cl.[4] ..... F41F 1/02

[52] U.S. Cl. ..... 89/8; 124/3; 310/13

[58] Field of Search ..... 89/8; 310/12, 13, 14; 124/3; 318/135

[56] References Cited

U.S. PATENT DOCUMENTS

| | | | |
|---|---|---|---|
| 4,319,168 | 3/1982 | Kememy | 89/8 X |
| 4,329,971 | 5/1982 | Kemeny et al. | 89/8 |
| 4,343,223 | 8/1982 | Hawke et al. | 89/8 |
| 4,423,662 | 1/1984 | McAllister | 89/8 |
| 4,437,383 | 3/1984 | Deis et al. | 89/8 |
| 4,449,441 | 5/1984 | McAllister | 89/8 |

*Primary Examiner*—David H. Brown
*Assistant Examiner*—John E. Griffiths
*Attorney, Agent, or Firm*—R. P. Lenart

[57] ABSTRACT

An electromagnetic projectile launcher is provided with muzzle circuitry which increases the rate of dissipation of inductively stored rail energy following the launch of a projectile and can be used to recover a portion of that stored energy for use in successive launches. The muzzle circuitry includes a pair of conductors which lie adjacent to the projectile launching rails and conduct current in a direction which is opposite to the current flow in the projectile rails. These conductors may be connected to a pulse transformer to increase the post-launch current of an inductive energy storage device. In an alternative embodiment, a capacitive muzzle circuit is used to store the inductive rail energy and inject current into the projectile launching rails during the launch of a successive projectile.

14 Claims, 2 Drawing Sheets

ELECTROMAGNETIC LAUNCHER WITH IMPROVED RAIL ENERGY RECOVERY OR DISSIPATION

BACKGROUND OF THE INVENTION

This invention relates to electromagnetic projectile launchers and more particularly to such launchers which include structures for recovering inductively stored rail energy or for accelerating current decay following the launch of a projectile.

In a simple parallel rail electromagnetic launcher system, the inductively stored rail energy at the time of projectile exit is equal to $\frac{1}{2}$ $L' \times I^2_m$ where $L'$ is the barrel inductance gradient, $\times$ is the barrel length, and $I_m$ is the muzzle current. The instantaneous accelerating force on a projectile is $\frac{1}{2}$ $L'I^2$ and, therefore, the total energy E imparted to a projectile, neglecting friction, is given by the equation:

$$E = \int F dx = \int \tfrac{1}{2} L' I^2 dx \quad (1)$$

If launcher barrel length is to be minimized, the maximum allowable force must be sustained throughout the bore length. In that case, the current must stay constant at its maximum level and, immediately following a projectile launch, the remaining rail inductive energy will be $\frac{1}{2}$ $L' \times I^2$ which is then exactly equal to the projectile kinetic energy. Thus, for minimum barrel length and constant accelerating current, neglecting all rail resistance, 50% of the energy supplied at the breech will remain inductively stored by the rails and this energy is normally wasted. In practice, and expecially if high efficiency is desired, the projectile is allowed to exit only after a significant current drop compared to the initial breech current, but this involves the penalty or detriment of a considerably longer barrel.

If the barrel has external augmenting turns, then at least some of the post-projectile-exit inductively stored rail energy can be returned to the inductive storage in the power supply. Such a launching system is disclosed in a copending commonly assigned application by Kemeny et al. entitled "Electromagnetic Projectile Launcher With Energy Recovering Augmenting Field And Minimal External Field", filed Apr. 23, 1981, Ser. No. 256,745 (W.E. Case 49,429). The beneficial energy conservation illustrated in that application is available because of the augmenting turns and is unavailable for a simple parallel rail launcher. For a simple parallel rail launcher configuration, a muzzle shunt resistor can be used to dissipate inductively stored rail energy. The rate of current commutation into the muzzle resistor is improved by adding higher impedance sections to the projectile launching rails at the muzzle ends.

The shunting resistor can be designed such that it does not produce an excessive voltage drop but still dissipates most of the energy and thus results in less heating of the projectile launching rails. In general, the rate of current decay after firing will be substantially slower than the current decay during the actual projectile acceleration, and for very rapid burst firing, this relatively slow decay will limit the attainable burst firing rate. Current decay can be accelerated by increasing the resistance of the muzzle shunt impedance, which decreases the circuit time constant, but this results in higher voltage across the shunt and more difficulty in commutating current into the shunt. The present invention provides launching systems which improve the rate of current decay after projectile exit and can recover a portion of the inductively stored rail energy for use in accelerating a successive projectile.

SUMMARY OF THE INVENTION

An electromagnetic projectile launcher constructed in accordance with the present invention comprises: a pair of conductive rails having a breech end and a muzzle end; a source of direct current connected to the rails; means for conducting current between the rails and for propelling a projectile along the rails; and means for increasing the rate of reduction of magnetic flux between a portion of the rails following the exit of the projectile. The means for increasing the rate of reduction of magnetic flux may include a pair of conductors lying adjacent to the conductive rails and connected to the muzzle end of the rails such that current flow through the conductors produces magnetic flux between the rails which is in a direction opposite to the magnetic flux produced by current flowing in the rails. A resistor may be connected in series with these conductors to dissipate the rail energy or the conductors may themselves have sufficient resistance to limit premature and parasitic current flow to less than a predetermined magnitude. In addition, switching means may be connected in series with these conductors to prevent premature current flow and to start current flow at the optimum time. Increased coupling may be provided by making the conductive rails and conductors substantially coaxial.

The launchers of this invention can also be configured to recover at least a fraction of the inductively stored projectile rail energy following the launch of a projectile by including a pulse transformer having first and second windings wherein the first winding is connected in series with the power source and the second winding is connected in series with the conductors used to increase the rate of flux reduction. In an alternative embodiment, energy recovery can be provided by connecting a capacitor array between the projectile launching rails at the muzzle end. Switching means must then be provided for initially transferring the rail inductive energy to the capacitor array and storing it there. Further means may be provided for discharging the capacitor array into the rails to increase current during the launch of a successive projectile.

The launchers of this invention accelerate projectiles in accordance with a method which comprises the steps of: passing a current through a pair of projectile launching rails and through a means for conducting current between the rails to create magnetic fields which interact to propel the means for conducting current and an associated projectile along the rails; and increasing the rate of injection of muzzle current into a muzzle shunt circuit by folding conductors in the muzzle shunt circuit toward the breech end of the projectile launching rails.

DESCRIPTION OF THE PREFERRED EMBODIMENTS

Figure 1:
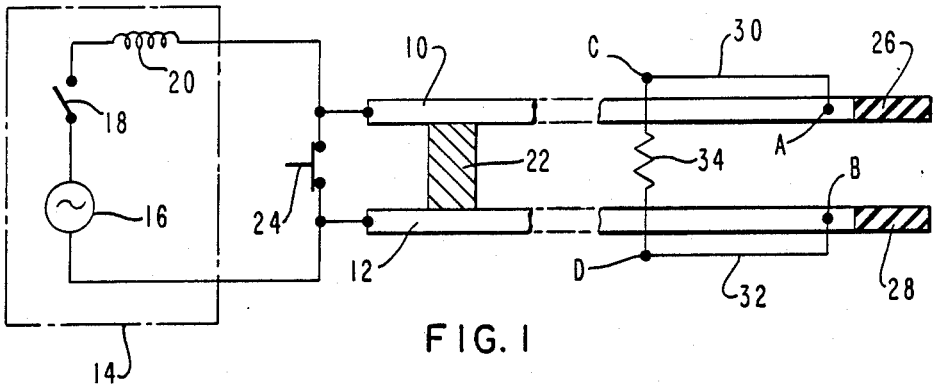
FIG. 1 is a schematic diagram of an electromagnetic projectile launcher system constructed in accordance with one embodiment of the present invention.

Referring to the drawings, FIG. 1 is a schematic diagram of an electromagnetic projectile launching system constructed in accordance with one embodiment of the present invention. A pair of generally parallel conductive projectile launching rails 10 and 12 are connected to a source of high current 14 which includes, for example, the series connection of a generator 16, switch 18, and inductive energy storage device 20. Of course, other known current sources can also be used in the launching systems of this invention. An arc or metallic conductive armature 22 is located between the projectile launching rails and serves as means for conducting current between the rails and for propelling a projectile along the rails. A firing switch 24 is connected to the breech end of the projectile launching rails 10 and 12. Insulating or higher resistance rail segments 26 and 28 are provided adjacent to the muzzle end of projectile launching rails 10 and 12, respectively, to improve the rate of current commutation into the means for increasing the rate of reduction of magnetic flux in a portion of the projectile launching rails following the launch of a projectile. This means for increasing the rate of reduction of magnetic flux includes a pair of conductors 30 and 32 which are connected to points A and B adjacent to the muzzle ends of projectile launching rails 10 and 12, respectively, and are positioned closely adjacent to rails 10 and 12 such that current flow in each rail and the adjacent conductor is in the opposite direction. Resistor 34 is connected to conductors 30 and 32, for example at points C and D. Electromagnetic projectile launching systems have been proposed which are similar to the launcher of FIG. 1, but wherein the resistor 34 is connected directly across points A and B. That configuration permits energy dissipation but current decay is rather slow and results in complete wastage of the inductively stored energy which remains after a projectile has been launched. This invention utilizes conductors 30 and 32 to accelerate energy dissipation, which is favorable, especially for a rapid fire scenario but can, in other embodiments, additionally return some of this energy back to the inductor loop of the power supply thus conserving energy, increasing efficiency and resulting in more shots for a given magnitude of prestored energy. Furthermore, by not wasting all of the post-firing rail inductive energy, higher efficiencies are obtainable at higher muzzle-to-breech current ratios and therefore there is less penalty due to efficiency loss for near-to-constant current acceleration, which, of course, results in reduced barrel length at still high efficiency levels.

Figure 2:
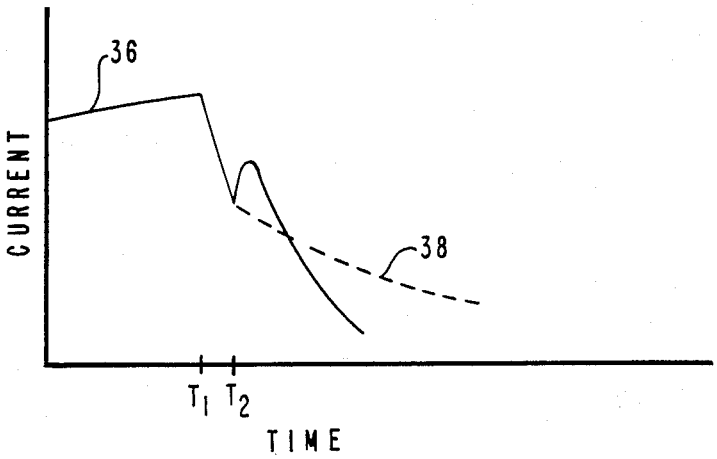
FIG. 2 is a graph of current flow during the launch of a projectile in the launcher of FIG. 1.

The operation of the launcher shown in FIG. 1, which does not include energy recovery means, will be discussed with reference to the graph of FIG. 2. In order to launch a projectile, switches 18 and 24 are initially closed and inductive energy storage device 20 is charged to a predetermined firing current level. The current in the system is illustrated by the solid curve 36 in FIG. 2. At time $T_1$, firing switch 24 is opened and current is commutated into projectile launching rails 10 and 12 and through armature 22 to propel the armature along the rails. Current in the system rapidly decreases as shown by curve 36 in FIG. 2 between times $T_1$ and $T_2$. At time $T_2$, armature 22 passes from the muzzle end of rails 10 and 12 into the insulating or higher impedance rail segments 26 and 28 downstream of the shunt attachment points A and B. The resulting increasing voltage across attachment points A and B will hasten commutation of current into the shunt loop which comprises the series connection of conductor 30, resistor 34 and conductor 32. Conductors 30 and 32 essentially parallel the projectile launching rails, but have current flow opposite to that in the rails. Because of this geometry, the firing rails in series with the shunt loop have a lower inductance than the firing rail loop alone. The current will therefore now rapidly rise during commutation and then, in turn, more rapidly decay. The rapid rise of current is due to substantial conservation of magnetically stored energy during the commutation of current into a lower inductance loop. A rather similar current increase procedure is described in my copending application Ser. No. 443,730, filed Nov. 22, 1982 and entitled "Burst Firing Electromagnetic Launcher Utilizing Variable Inductance Coils", (W.E. Case 50,706). The broken curve 38 of FIG. 2 approximates the current decay of a system wherein resistor 34 is connected directly to points A and B. The more rapid decay after time $T_2$, illustrated by curve 36, is due to a decrease in the circuit time constant L/R wherein the inductance L has decreased and the resistance R of the system has increased through the addition of shunt loop ACDB.

It should be understood that although a separate muzzle resistor 34 has been illustrated, such a separate unit is not required as the loop ACDB can be designed to have the required or optimum resistance by simply using a cable size and material which yields the desired resistance. Curve 36 in the graph of FIG. 2 gives an estimate of the current attainable with the embodiment of FIG. 1. As can be seen, the current first rises rapidly during the commutation and then more rapidly decays as compared with broken curve 38. With everything else unchanged, the rapidity of commutation will be improved by increasing the voltage across the muzzle loop terminations A and B. Thus, increased muzzle velocity yields a higher commutation voltage and the desired faster commutation. The ratio of the current after commutation to the initial muzzle current is, under ideal conditions, equal to the square root of the ratio of the initial rail loop inductance to the lower inductance of the final loop which includes the muzzle shunt circuitry. The ratio of these inductances depends on how large a fraction of the total rail length is paralleled by the conductors 30 and 32 and on the extent by which current in these conductors opposes or reduces the initial rail bore flux.

Figure 3:
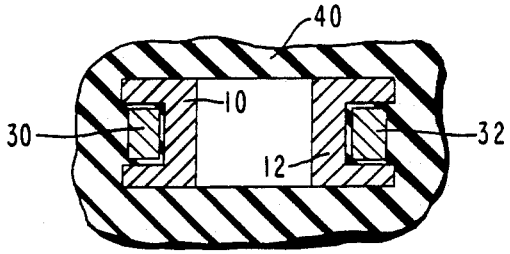
FIG. 3 is a cross-sectional view of a projectile launching rail assembly for use in the launcher of FIG. 1.

To yield the desired low inductance after current flows in the rails and muzzle shunt loop, the shunt leads should closely parallel the rails. FIG. 3 shows a cross section of projectile launching rails which may be used in the launcher of FIG. 1. Projectile launching rails 10 and 12 and muzzle shunt circuit conductors 30 and 32 are held in position by an insulating support structure 40. In this embodiment, the muzzle shunt leads are essentially coaxial with the individual projectile launching rails, thus yielding an even lower inductance assembly and hence a higher current peak and faster decay. Additionally, the scheme of paralleling the projectile rails with the shunt leads carrying current in an opposite direction causes very rapid decay of the barrel stray or fringe field in the bore length paralleled by the shunt leads, thereby hindering detection by hostile magnetic field sensors.

Figure 4:
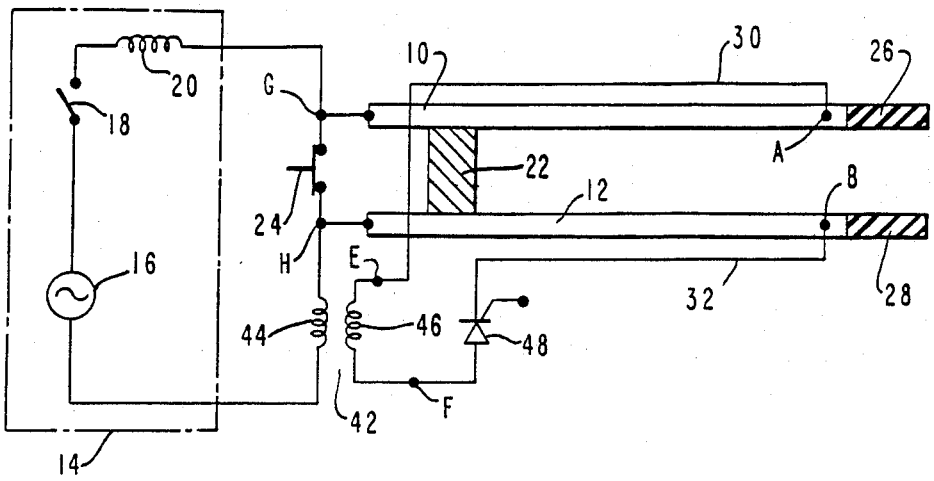
FIGS. 4 and 5 are embodiments of the present invention which include energy recover means.

FIG. 4 is a schematic diagram of an electromagnetic projectile launching system which allows the recovery of at least some of the stored inductive rail energy which is initially trapped in the projectile launching rail loop before the projectile bridges the rails at terminations A and B. In this embodiment, the muzzle shunt conductors 30 and 32 have been extended and are connected in series with an air core pulse transformer 42 which includes a first winding 44 and a second winding 46. The first winding 44 serves as an auxiliary inductor in series with power supply 14 and the turns of the first and second windings cooperatively link the same flux. In this configuration, the current pulse produced during commutation and current decay in the loop AEFB induces a current in the first winding 44 and, by using proper winding directions, the current in the first winding will be in a direction which increases current in the main storage inductor 20 thus recovering energy. The existence of the first winding 44 as an auxiliary inductor, is not detrimental as, for example without loop AEFB, the inductive energy storage in the first winding simply adds to the total inductively stored energy. During charging of the main and auxiliary inductors, a current will be parasitically induced in the closed loop EFB-HGAE, where segment HG represents the closed firing switch 24. Whether this current flow wastes a significant quantity of energy depends on circuit parameters, geometry, and on how fast current is built up in the inductors. During firing, very rapid current drop in the first winding 44 will certainly produce a significant current in the loop which includes circuit AEFB and which loop is now closed by the projectile armature or plasma 22. Such parasitic current flow can be readily prevented and this is accomplished, for example, by a series circuit element such as thyristor array 48 which can be triggered by the voltage across terminations A and B produced as the projectile passes these points.

The current magnitude during the commutation pulse into the loop AEFB will depend on the circuit parameters. For example, if the reduction in inductance due to the paralleling of conductors 30 and 32 to the driving rails about equals the addition of inductance due to the turns of the secondary winding 46, then the pulse current magnitude will not exceed the muzzle current level. If the reduction in inductance due to the paralleling well exceeds the addition of inductance by the secondary winding 46, then current can increase and the current pulse will resemble that of curve 36 following $T_2$ in FIG. 2. Although the launcher of FIG. 4 illustrates an embodiment with shunt conductors 30 and 32 parallel to the projectile launching rails 10 and 12, the muzzle rail terminations A and B could also be connected to the secondary winding terminations E and F by suitable external and preferably very low inductance cabling. In such a case, the muzzle plus rail loop EFB-HGAE will definitely have a higher inductance than the rail loop BHGAB alone and the current after commutation will be lower than the muzzle current, current injection into the increased inductance will take longer, and pulse transformer operation should be less favorable. In general, the launcher configuration of FIG. 4 will result in both energy recovery to allow more shots for a given prestorage energy level, and faster current decay to allow shots in more rapid succession.

Figure 5:
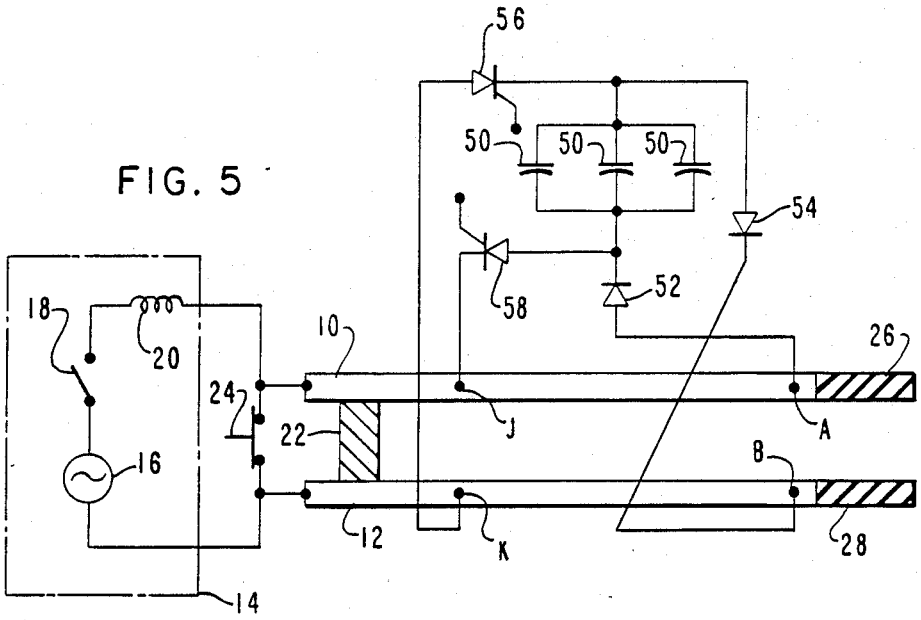

FIG. 5 is a schematic diagram of an alternative embodiment of the present invention utilizing a muzzle energy recovery system wherein the post-firing rail inductive energy is first transferred to a capacitor array. In this embodiment, the muzzle shunt circuit includes a series connection of diode arrays 52 and 54 and a capacitor bank which includes the parallel connection of capacitors 50. When armature 22 passes termination points A and B, commutating the current into the capacitor array is electrically very favorable since the uncharged capacitors not only act initially as a short circuit, but after projectile exit and completion of commutation, and hence cessation of current flow, for example by arching directly across the rails, the rail current flow will go to zero in a normal oscillatory inductor-capacitor circuit manner and at this current zero, the circuit can be opened to trap the remaining post-firing energy in the capacitor array. That energy can then be used for even a long-delayed successive shot.

FIG. 5 shows circuitry wherein the muzzle capacitors 50 are connected through switching devices 56 and 58 to projectile launching rails 10 and 12 at points J and K. This configuration allows the muzzle capacitors to reinject current, through synchronized switching, into the projectile rails to raise the attenuated driving current level of a successive projectile back to nearer breech current magnitude for successive shots. Another alternative is to discharge the capacitors into a pulse-type transformer for successive shots in a manner similar to that shown in FIG. 4. With that alternative, a pulse transformer such as 42 in FIG. 4 would be inserted in series with the power supply and the capacitor array would be connected to terminals E and F of winding 46 of the transformer through switching devices 56 and 58. With the FIG. 5 type of system, useful energy recovery, that is, the fraction of post-firing rail inductive energy which can be supplied back into the rails for a subsequent shot, can be expected to be considerably better than 50%. The disadvantage of the FIG. 5 capacitor system is that the size and cost of conventional and presently available capacitors will make such a system unattractive for mobile applications. Nevertheless, such capacitive rail energy storage systems may become more versatile as more compact high energy storage capacitors become available.

It should be observed that a commutating voltage which aids current injection into the shunt loop will be generated as soon as armature motion causes the flux in the shunt loop to increase. For example, in FIG. 1, such a voltage is generated when the projectile armature passes connection points C and D. This induced voltage is generated until the armature exits the launcher. Thus the folding of shunt leads toward the breech not only creates a voltage in a direction which aids in commutating current into the shunt, but also maintains this voltage for a sufficiently long time to allow the commutation of the desired fraction of the current. The magnitude of this induced voltage will be comparable to the back EMF and can thus reach the value of $IL'v$ where v is the projectile velocity. For example, at $I=1$ MA, $L'=0.5$ $\mu$H/m and $v=2000$ m/sec, the injecting voltage can reach 1000 volts which will certainly hasten current injection into the muzzle shunt loop.

Thus folding of the muzzle shunt circuit leads from their attachment points backward toward the breech, causes an earlier application of current injection voltage and hastens commutation of current into the shunt loop. In FIG. 5, the leads from the projectile rails to circuit elements 52 and 54 are therefore shown to be folded toward the breech, thereby causing earlier energy injection into the muzzle shunting capacitors. It should be understood that additional conductors which are electrically connected in parallel with the backward folded muzzle shunt circuit conductors can be added to the launchers of FIGS. 1, 4 and 5. These additional conductors would be symmetrically disposed on opposite sides of the projectile launching rails in a manner similar to that shown for the backward folded portions of the muzzle shunt circuit conductors in FIGS. 1, 4 and 5.

Because a voltage which will tend to inject current into the shunt loop is generated as soon as flux is injected into this loop by the motion of the projectile, a thyristor assembly such as 48 in FIG. 4 will be required if the muzzle shunt loop extends over a substantial portion of the projectile rails as it does in FIG. 4. This thyristor assembly or other switching means is then triggered to conduct as soon as it is desired to start injecting current into the shunt loop.

While the present invention has been described in terms of what are at present believed to be the preferred embodiments, it will be apparent to those skilled in the art that various changes may be made to these embodiments without departing from the scope of the invention. It is, therefore, intended that the appended claims cover all such changes.

What is claimed is:

1. An electromagnetic projectile launcher comprising:

a pair of conductive rails each having a breech end and a muzzle end;

a source of current connected to the breech ends of said rails;

means for conducting current between said rails and for propelling a projectile along said rails; and a muzzle shunt circuit including a pair of conductors connected to said muzzle end of said rails and located adjacent to and parallel to said rails such that a muzzle shunt circuit commutating voltage is induced during the time that said means for conducting current travels in a portion of said rails which is paralleled by said conductors and wherein the induced voltage continues until said means for conducting current exits at the muzzle ends of said rails.

2. A method of electromagnetically accelerating projectiles, comprising the steps of:

passing a current through a pair of projectile launching rails and through a means for conducting current between the rails to create magnetic fields which interact to propel the means for conducting current and an associated projectile along the rails; and increasing the rate of injection of muzzle current into a muzzle shunt circuit electrically connected in series with the rails, by passing current through conductors in the muzzle shunt circuit thereby producing magnetic flux between the rails having a polarity which is opposite to magnetic flux between the rails produced by current flowing in the projectile launching rails.

3. An electromagnetic projectile launcher comprising:

a pair of conductive rails, each having a breech end and a muzzle end;

a source of current connected to the breech ends of said rails;

means for conducting current between said rails and for propelling a projectile along said rails;

means for inductively increasing the rate of current reduction in said rails following a launch of said projectile a first conductor having a first end electrically connected to the muzzle end of a first one of said rails;

a second conductor having a first end electrically connected to the muzzle end of a second one of said rails;

means for electrically connecting a second end of said first conductor to a second end of said second conductor;

at least a portion of said first conductor lying adjacent to said first rail and extending from a first point adjacent to the muzzle end of said first rail toward the breech end of said first rail, and at least a portion of said second conductor lying adjacent to said second rail and extending from a second point adjacent to the muzzle end of said second rail toward the breech end of said second rail, such that current flow through said conductors produces magnetic flux between said conductive rails which is in a direction opposite to that of magnetic flux produced by current flowing in said conductive rails.

4. An electromagnetic projectile launcher as recited in claim 3, wherein said means for electrically connecting comprises:

a resistor connected in series with said conductors.

5. An electromagnetic projectile launcher as recited in claim 3, wherein said conductors and said conductive rails are coaxial.

6. An electromagnetic projectile launcher as recited in claim 3, further comprising:

insulating rail segments adjacent to said muzzle end of said conductive rails.

7. An electromagnetic projectile launcher as recited in claim 3, further comprising:

switching means for preventing premature current flow in said conductors during projectile acceleration.

8. An electromagnetic projectile launcher as recited in claim 7, further comprising:

a pulse transformer having first and second windings wherein said first winding is connected in series with said source of current and said second winding is connected in series with said pair of conductors.

9. An electromagnetic projectile launcher comprising:

a pair of conductive rails, each having a breech end and a muzzle end;

a source of current connected to the breech ends of said rails;

means for conducting current between said rails and for propelling a projectile along said rails;

a first conductor having a first end electrically connected to the muzzle end of a first one of said rails;

a second conductor having a first end electrically connected to the muzzle end of a second one of said rails;

at least a portion of said first conductor lying adjacent to said first rail and extending from a first point adjacent to the muzzle end of said first rail toward the breech end of said first rail, and at least a portion of said second conductor lying adjacent to said second rail and extending from a second point adjacent to the muzzle end of said second rail toward the breech end of said second rail, such that current flow through said conductors produces magnetic flux between said conductive rails and which is in a direction opposite to that of magnetic flux produced by current flowing in said conductive rails; and a capacitor array electrically connected between said conductors.

10. An electromagnetic projectile launcher as recited in claim 9, further comprising:

switching means for transferring post acceleration rail inductive energy to said capacitor array, to store said energy in said capacitor array.

11. An eletromagnetic projectile launcher as recited in claim 9, further comprising:

means for discharging said capacitors into said rails at a point spaced from said muzzle end, to increase current during the launch of a successive projectile.

12. An electromagnetic projectile launcher comprising:

a pair of conductive rails each having a breech end and a muzzle end;

a source of current connected to the breech ends of said rails;

means for conducting current between said rails and for propelling a projectile along said rails;

a muzzle shunt circuit including a first conductor being electrically connected adjacent to the muzzle end of a first one of said rails and a second conductor being electrically connected adjacent to the muzzle end of a second one of said rails, wherein portions of said first and second conductors extend from points adjacent to the muzzle ends of said rails toward the breech ends of said rails and lie adjacent to corresponding ones of said rails so that injection of muzzle current into the shunt circuit is inductively aided.

13. An electromagnetic projectile launcher as recited in claim 12, further comprising:

insulating rail segments adjacent to the muzzle ends of said conductive rails, which increase the rate of current injection into the shunt circuit.

14. An electromagnetic projectile launcher as recited in claim 12, further comprising:

switching means connected in series with said muzzle shunt circuit conductors to prevent premature parasitic current flow in said conductors.

* * * * *